United States Patent [19]

Lengnick et al.

[11] Patent Number: 4,671,933

[45] Date of Patent: Jun. 9, 1987

[54] METHOD FOR INHIBITING CORROSION OF METAL SURFACES

[75] Inventors: Guenther F. Lengnick, Adrian, Mich.; Albert J. Sanders, Jr., Toledo, Ohio; William J. Swatos, Tecumseh, Mich.

[73] Assignee: Stauffer-Wacker Silicones Corporation, Adrian, Mich.

[21] Appl. No.: 816,954

[22] Filed: Jan. 8, 1986

Related U.S. Application Data

[63] Continuation-in-part of Ser. No. 747,751, Jun. 24, 1985, abandoned.

[51] Int. Cl.[4] ..... C23F 11/02

[52] U.S. Cl. ..... 422/9; 252/389.32

[58] Field of Search ..... 556/410, 412; 252/389.32, 11, 14; 422/9

[56] References Cited

U.S. PATENT DOCUMENTS

| | | | |
|---|---|---|---|
| 3,032,528 | 5/1962 | Nitzsche et al. | 528/34 |
| 3,085,908 | 4/1963 | Morehouse et al. | 428/336 |
| 3,198,747 | 8/1965 | Cook et al. | 252/182 |
| 3,234,144 | 2/1966 | Morehouse | 252/389.2 |
| 3,408,325 | 10/1968 | Hittmair et al. | 528/34 |
| 3,451,964 | 6/1969 | Creamer | 524/448 |
| 3,464,951 | 9/1969 | Hittmair et al. | 524/864 |
| 3,644,434 | 2/1972 | Hittmair et al. | 524/493 |
| 3,672,822 | 6/1972 | Vedder et al. | 422/9 |
| 3,785,975 | 1/1974 | Humphrey et al. | 252/392 X |
| 3,816,164 | 6/1974 | Pepe et al. | 428/447 |
| 3,816,333 | 6/1974 | King et al. | 252/389.22 |
| 3,967,926 | 7/1976 | Rozenfeld et al. | 422/9 |
| 4,101,431 | 7/1978 | Kuntschik | 252/389.2 X |
| 4,308,168 | 12/1981 | Sato et al. | 252/389.61 X |
| 4,565,885 | 1/1986 | Webb et al. | 556/410 |

FOREIGN PATENT DOCUMENTS

| | | | |
|---|---|---|---|
| 240286 | 12/1960 | Australia | 252/396 |

OTHER PUBLICATIONS

Evans, U. R., *The Corrosion and Oxidation of Metals: Scientific Principles and Practical Applications,* Edward Arnold Publishers, (London), (1967).

*Primary Examiner*—John F. Terapane
*Assistant Examiner*—Matthew A. Thexton

[57] ABSTRACT

A method for inhibiting corrosion of metal surfaces which comprises exposing the metal surfaces to an aminosilicon compound which is capable of hydrolyzing and releasing a volatile amine in the presence of atmospheric moisture.

14 Claims, No Drawings

METHOD FOR INHIBITING CORROSION OF METAL SURFACES

RELATED APPLICATIONS

This application is a continuation-in-part application of copending application Ser. No. 747,751, now abandoned filed June 24, 1985.

The present invention relates to a method for inhibiting corrosion of metal surfaces and more particularly to a method of inhibiting corrosion of metal surfaces which are in contact with corrosive elements normally present in the atmosphere. More particularly, this invention relates to a method for inhibiting the corrosion of metal surfaces by utilizing an amine containing silicon compound either alone or in combination with a carrier.

BACKGROUND OF THE INVENTION

Amine containing compounds have been employed heretofore to inhibit corrosion of metal surfaces. For example, U.S. Pat. No. 3,198,747 to Cook et al discloses an aqueous composition containing an organic amine and an organopolysiloxane as a corrosion inhibiting composition. Also, U.S. Pat. No. 3,085,908 to Morehouse et al discloses a process for treating metal surfaces to inhibit corrosion by applying to the metal surface an aminoalkyl silicon compound selected from aminoalkylakoxysilanes and aminoalkylpolysiloxanes and thereafter curing the aminoalkyl silicon compound on the surface to form an adherent coating thereon. Morehouse also discloses in U.S. Pat. No. 3,234,144 a process for retarding corrosion of metals which come in contact with water by adding to the water an organosilicon compound having an amino group linked to a silicon atom by a divalent hydrocarbon group having at least three carbon atoms. Other amine containing compounds which have been used as corrosion inhibitors are the polyalkylene polyamine derivatives disclosed in U.S. Pat. No. 3,816,333 to King et al in which the polyalkylene polyamine derivatives are added to an aqueous corrosive medium.

The aminosilicon compounds described in the above references have an amino group linked to the silicon atom via a divalent hydrocarbon radical, whereas in the aminosilicon compounds employed in the present invention, the amino group is linked to the silicon atom through an Si-N linkage.

Therefore, it is an object of this invention to provide a method for inhibiting corrosion of metal surfaces. Another object of this invention is to provide a method for inhibiting corrosion of ferrous metals such as iron and steel. Another object of the present invention is to provide a method for inhibiting corrosion of metal surfaces by applying a corrosion resistant composition to the metal surfaces. Still another object of this invention is to provide a method for inhibiting corrosion of metals which does not require direct treatment of the surface to be protected. A further object of this invention is to provide a barrier between the surface to be protected and the corrosive elements normally present in the atmosphere.

SUMMARY OF THE INVENTION

The foregoing objects and others which will become apparent from the following description are accomplished in accordance with this invention, generally speaking, by providing a method for inhibiting corrosion of metal surfaces which comprises exposing the metal surfaces to an aminosilicon compound having at least one amine group linked to the silicon atom through an Si-N linkage which is capable of hydrolyzing and releasing a volatile amine in the presence of atmospheric moisture.

DESCRIPTION OF THE INVENTION

Aminosilicon compounds which may be used to inhibit corrosion of metal surfaces are preferably aminosilanes of the formula

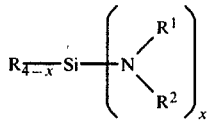

and aminosilazanes of the general formula

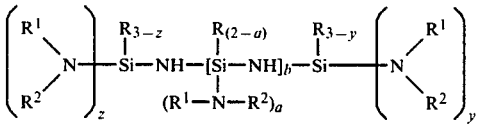

in which R is a monovalent hydrocarbon radical having from 1 to 18 carbon atoms or a radical of the formula $R'O(R''O)_c$, where R' is hydrogen or a monovalent hydrocarbon radical having from 1 to 18 carbon atoms, R'' is a divalent hydrocarbon radical having from 2 to 6 carbon atoms, $R^1$ and $R^2$, which may be the same or different, represent monovalent hydrocarbon radicals having from 1 to 10 carbon atoms, hydrogen or a radical of the formula R''OH, where R'' is the same as above, a is 1 or 2, b is an integer of from 0 to 3, c is an integer of from 0 to 600, x has an average value of at least 1 and up to 4, y is an integer of from 0 to 3, z is an integer of from 0 to 3 and the sum of y+z is equal to at least 2.

Examples of monovalent hydrocarbon radicals represented by R and R' are alkyl radicals such as methyl, ethyl, propyl, butyl, hexyl, octyl, decyl and octadecyl radicals; alkenyl radicals such as the vinyl and allyl radicals; aryl radicals such as the phenyl and anthracyl radicals; cycloalkyl radicals such as the cyclohexyl radical; aralkyl radicals such as the benzyl and phenylethyl radicals and alkaryl radicals such as the tolyl and xylyl radicals.

Examples of monovalent hydrocarbon radicals represented by $R^1$ and $R^2$ having up to 10 carbon atoms are alkyl radicals such as the methyl, ethyl, propyl, butyl, hexyl, octyl and decyl radicals; aryl radicals such as the phenyl radical; cycloalkyl radicals such as the cyclohexyl radical; aralkyl radicals such as the benzyl and phenylethyl radicals and alkaryl radicals such as the tolyl and xylyl radicals.

Examples of divalent hydrocarbon radicals represented by R'' having from 2 to 6 carbon atoms are ethylene, trimethylene, tetramethylene, pentamethylene and phenylene radicals.

Specific examples of divalent radicals represented by the radical (R''O) are ethylene oxide, propylene oxide, butylene oxide, phenylene oxide and polymers and copolymers thereof.

Examples of suitable aminosilanes which may be employed in this invention are methyltri(cyclohexylamino)silane, dimethyldi(cyclohexylamino)silane, butyltri(ethylamino)silane, methyltri(n-butylamino)silane, ethyltri(butylamino)silane, propyltri(n-butylamino)silane, ethyltri(phenylamino)silane, methyltri(phenylamino)silane, vinyltri(phenylamino)silane, phenyltri(dimethylamino)silane, hexyltri(n-butylamino)silane, methyltri(n-hexylaminosilane, ethyltri(methylhexylamino)silane, phenyltri(n-pentylamino)-silane, butyltri(phenylamino)silane, methyltri(sec-butylamino)silane, methylmethoxy di(ethylamino)silane, ethoxytri(methylamino)silane methyltri(ethanolamino)silane, dimethyldi(ethanolamino)silane, ethyltri(propanolamino)silane, dimethyldi(-butanolamino)silane and partial hydrolyzates thereof.

Examples of aminosilanes, which may be employed in this invention are described, for example, in U.S. Pat. Nos. 3,408,325 to Hittmair et al; 3,464,951 to Hittmair et al; 3,451,964 to Creamer; and 3,644,434 to Hittmair et al, which are incorporated herein by reference.

The aminosilazanes are described, for example, in U.S. Pat. No. 3,032,528 to Nitzsche et al, which is also incorporated herein by reference.

The aminosilicon compounds having an Si-N linkage may be applied directly to the metal surface or the metal surface may be exposed to vapors released in a closed environment as a result of the hydrolysis of the aminosilicon compounds in the presence of moisture. For example, the aminosilicon compounds may be included in a sealed package, such as a cellophane package, with a metal part which is to be protected against corrosion.

In addition, the aminosilanes having an Si-N linkage may be applied to porous carriers, or finely divided particles such as silica gel, zeolite, paper, textile materials, wood, diatomaceous earth, chalk, glass, fumed silica and magnesium silicates. When the aminosilicon compounds are applied, for example to paper, the coated or impregnated paper may be used to wrap the metal part to be protected against the corrosive elements present in the atmosphere.

Impregnation or coating of the carrier may be achieved using a dilute solution, preferably an organic solvent medium, which is inert to the aminosilicon compound. The extent of impregnation and coating of the corrosion inhibitor on the solid depends a great deal on the absorbency of the carrier and the concentration of solvents in the treating composition. Solutions containing the aminosilicon compound in the desired proportion may be formulated with concentrations ranging from 3 to 75 percent by weight solids, depending on the solubility of the aminosilicon compound.

The corrosion inhibitors of this invention can be dissolved or dispersed in any inert solvent in which the solvent does not attack the Si-N linkage of the aminosilicon compound. Hydrocarbon solvents such as benzene, toluene, xylene, petroleum ether, diethyl ether, dibutyl ether, alcohol and methylisobutylketone can be employed.

The aminosilicon compounds of this invention may be applied to the substrates or carriers such as paper, by the usual techniques of roller coating, flow coating, brushing, dipping, impregnating, spraying and the like. When a diluent is employed, it may be removed by exposing the impregnated substrate to an anhydrous atmosphere at an elevated temperature.

When the carrier consists of an absorbent material, such as paper, textiles, fabric and the like, which has been impregnated with a predetermined concentration of aminosilicon compound, it may be subdivided into small segments for insertion as packing into confined areas for metal protection purposes. Also, it may be applied as a contoured segment to cover the area of metal to be protected, or it may be used as an interlayer between metal sheets while in storage or while in shipment from one place to another; or it may be used as a wrapper to substantially enclose the metal object to be protected during shipment and/or storage. The impregnated absorbent material may be used not only to protect the metal surface from corrosion, but also to minimize damage to the metal part by impact or abrasion.

When used as a wrapper, it is preferred that the absorbent material be provided with a layer of impervious waterproof material which resists vapor penetration and thereby forms an additional barrier against filtration of corrosive vapors from the atmosphere while minimizing loss by dissipation of the protected vapors generated from the corrosion inhibiting composition. Thus, by using such means, the amount of corrosion inhibiting composition required in or near the vicinity of the metal surface may be lessened or a corresponding increase in the useful life of the composition may be obtained.

The aminosilicon compounds of this invention may be combined with other carriers to form corrosion inhibiting compositions. They may be incorporated in, for example, oils such as lubricating oils, light oils, brake fluids, antifreeze or synthetic lubricating oils, greases, asphalt base coatings, polyesters, glycol, glycol ethers and silicone fluids such as dimethylpolysiloxane fluids, methylvinylsiloxane fluids, phenylmethylsiloxane fluids, hydroxyl-containing dimethylpolysiloxanes, as well as hexamethylcyclotrisiloxane and octamethyltetracyclosiloxane to form corrosion inhibiting compositions.

Hydroxyl-containing diorganopolysiloxanes which may be combined with the aminosilanes may be represented by the general formula $$HO_m(R'''_nSiO_{\frac{4-n}{2}})_eH$$

where each R''' is a monovalent hydrocarbon radical having up to 18 carbon atoms, m has an average value of 0.99 to 1.01, n has an average value of 1.99 to 2.01, $m+n=3$ and e is an integer of from 2 to 70.

These diorganopolysiloxanes are linear polymers and contain predominantly $R'''_2SiO$ units. However, limited proportions, preferably below 5 mol percent of other siloxane units may be present such as $R'''SiO_{3/2}$ units, $R'''_3SiO_{\frac{1}{2}}$units and/or $SiO_{4/2}$ units may be present. Also monofunctional diorganopolysiloxanes having one hydroxyl group linked to only one terminal silicon atom and an $R'''_3SiO_{\frac{1}{2}}$unit linked to the other terminal silicon atom, may be employed as carriers in this invention.

It is preferred that the diorganopolysiloxanes have a viscosity of from about 2 to 100 mPa.s at 25° C. and more preferably from about 10 to 80 mPa.s at 25° C.

When the aminosilanes are combined with the hydroxylcontaining diorganopolysiloxanes, they are generally mixed under anhydrous conditions in the absence of fillers and applied in close proximity to or on the metal substrate and then exposed to atmospheric moisture.

The aminosilicon compounds may also be combined with sublimable carriers such as hexamethylcyclotrisiloxane. The sublimation rate of hexamethylcyclotrisiloxane can be controlled by adjusting the size of the openings of the container in which the hexamethylcyclotrisiloxane and the aminosilicon compounds are exposed to the environment or by admixing a slow-subliming substance such as tetramethylcyclobutanedione with the hexamethylcyclotrisiloxane.

The aminosilicon compounds may also be combined with propellents and dispersed in aerosol containers. Propellents which may be employed are hydrocarbons, such as propane and isobutane and inert gasses such as nitrogen, argon, helium and fluorocarbons. These aminosilicon compounds may be applied directly to a metal surface in a closed environment or they may be applied to the environment in close proximity to the metal surface to be protected and then hydrolyzed in the presence of atmospheric moisture to release the amine corrosion inhibitor.

The amount of aminosilicon compound incorporated with these carriers is not critical and may vary over wide limits depending upon the corrosion resistance desired, such as the type of oil, the object of the application and the like. In general, it has been found that good corrosion resistance is obtained when the amount of aminosilicon compound ranges from about 0.1 part up to about 100 parts per 100 parts by weight of the carrier.

The amount of aminosilicon compound required to inhibit corrosion on a metal substrate is not critical and may range from as low as about 8.5 grams of aminosilicon compound per cubic foot of enclosed space surrounding the metal substrate. More preferably, the lower range may range from about 9 to 20 grams of per aminosilicon compound per cubic foot of space surrounding the metal substrate. The upper limit of aminosilicon which can be present in the enclosed environment containing the metal substrate is not critical.

The aminosilicon compounds of this invention can be applied in different ways, depending upon the formulation. For example, when the vapor phase inhibitor is prepared by adding the aminosilicon compound to oil to form an oil base composition, the composition can be applied to the surface of various metals. The metal surface coated with the vapor phase inhibitor is maintained rust-free even if the coating is incompletely applied or the oil film is broken, because the vaporized amine protects the metal surface. When a small engine, for example, is run at the factory and then after removing the oil, is shipped or stored, the surfaces of the empty engine are liable to rust. However, when the aminosilicon compounds of this invention are incorporated in the run-in oil, the engine is protected from rust.

The corrosion inhibitor of this invention is distinguished by its high anti-corrosive ability and long diffusion distances of the volatile amine of the aminosilicon compound. Furthermore, the vapor phase inhibitor of this invention prevents corrosion of iron and ferrous metals and, therefore, can be applied in any system in which different metals are alloyed or in contact.

The corrosion resistance of the various aminosilicon compounds employed in the examples is determined in accordance with the following corrosion test procedure.

Corrosion Test

In the corrosion test, a metal strip is cleaned by scouring with an emery cloth, flushed with isopropanol and air dried. The metal strip is sprayed with distilled water and inserted in a glass jar with an aminosilicon compound and capped. A control sample using a strip of similar metal is simultaneously placed in another glass jar without the aminosilicon compound. The period of time before corrosion is observed on the metal strips is noted.

The following examples are illustrative of the various embodiments of the invention; however, they are in no way intended to limit the invention.

EXAMPLE 1

A freshly scoured low carbon steel strip is sprayed with water and placed in a 270 milliliter glass jar containing 0.1 g of methyltri(cyclohexylamino)silane, capped and observed in accordance with the test procedure described above. No corrosion is observed after seven days.

COMPARISON EXAMPLE $V_1$

A sample using a freshly scoured low carbon steel strip is sprayed with water and placed in a 270 milliliter glass jar, capped and observed in accordance with the test procedure described above. Corrosion is observed after one hour.

EXAMPLE 2

The procedure of Example 1 is repeated, except that freshly scoured metal strips are sprayed with water and placed in capped 270 milliliter glass jars with 1 g of each of the following aminosilicon compounds: Methyltri(ethylamino)silane, methyltri(n-propylamino)silane, methyltri(n-hexylamino)silane, methyltri(phenylamino)silane, methyltri(cyclohexylamino)silane, methyltri(n-heptylamino)silane, phenyltri(3,5,5-trimethylcyclohexylamino)silane, methyltri(sec-butylamino)silane, tetra(n-butylamino)silane, dimethylbis(cyclohexylamino)silane, vinyltri(phenylamino)silane, phenyltri(dimethylamino)silane, hexyltri(n-butylamino)silane, ethyltri(methylhexylamino)silane, dimethylbis(dibutylamino)silane and diethylbis(dibutylamino)silane. No corrosion is observed after seven days.

COMPARISON EXAMPLE $V_2$

The procedure described in Comparison Example $V_1$ is repeated, except that 0.1 g of cyclohexylamine is added to the jar and then capped. Corrosion is observed after less than 24 hours.

EXAMPLE 3

The procedure of Example 1 is repeated, except that 0.1 g of a mixture containing 42 g of methyltri(cyclohexylamino)silane and 58 g of a trimethylsiloxy endblocked dimethylpolysiloxane having a viscosity of 100 mPa.s at 25° C. is substituted for the 0.1 g of methyltri(cyclohexylamino)silane. No corrosion is evident after more than 7 days.

EXAMPLE 4

The procedure of Example 3 is repeated, except that 58 g of a petroleum oil (SAE 20) is substituted for the trimethylsiloxy endblocked dimethylpolysiloxane. After 7 days, no corrosion is observed on the metal strip.

EXAMPLE 5

The procedure of Example 3 is repeated, except that 58 g of hexamethylcyclotrisiloxane is substituted for the trimethylsiloxy endblocked dimethylpolysiloxane. No corrosion is observed after 7 days.

EXAMPLE 6

The procedure of Example 1 is repeated, except that 42 g of methyltri(cyclohexylamino)silane is mixed with 58 g of hydroxyl-terminated dimethylpolysiloxane having a viscosity of 50 mPa.s at 25° C. under anhydrous conditions. No corrosion is observed after 7 days.

EXAMPLE 7

The procedure of Example 1 is repeated, except that the composition is applied directly to the low carbon steel strip as a coating, allowed to cure for two hours in the atmosphere and then immersed in water. No corrosion is observed after 16 hours.

EXAMPLE 8

The procedure of Example 3 is repeated, except that 58 g of odorless mineral spirits are substituted for the trimethylsiloxy endblocked dimethylpolysiloxane. No corrosion is observed after 7 days.

EXAMPLE 9

The procedure of Example 3 is repeated, except that 42 g of methyltri(sec-butylamino)silane is substituted for the methyltri(cyclohexylamino)silane. No corrosion is observed after 7 days.

EXAMPLE 10

A composition containing 5 g of methyltri(cyclohexylamino)silane in 50 g of toluene is sprayed onto kraft paper and dried under anhydrous conditions. A scoured, damp steel substrate is then wrapped in the kraft paper. After 5 days no corrosion is observed.

COMPARISON EXAMPLE $V_3$

The procedure of Example 9 is repeated, except that the kraft paper is untreated. Corrosion is observed after about 1 day.

EXAMPLE 11

About 45 g of pulverized hexamethylcyclotrisiloxane are blended with 45 g of a dimethylpolysiloxane having methyl di(ethylamino)siloxy terminal groups and a viscosity of 50 mPa.s at 25° C. and sufficient fumed silica to provide a solid. The solid is placed in a glass jar with a freshly scoured low carbon steel strip which has been sprayed with water and capped. No corrosion is observed after seven days.

COMPARISON EXAMPLE $V_4$

The procedure of Example 11 is repeated, except that only hexamethylcyclotrisiloxane is placed in a glass jar with the metal strip. Corrosion is observed after one day.

What is claimed is:

1. A method for inhibiting corrosion of a ferrous metal substrate which comprises exposing the metal substrate in a closed environment to an aminosilicon compound having an Si-N linkage in the presence of moisture.

2. The method of claim 1, wherein the aminosilicon compound is an aminosilane of the formula

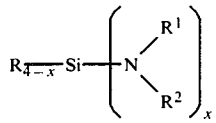

where R is selected from the group consisting of a monovalent hydrocarbon radical having from 1 to 18 carbon atoms, a radical of the formula $R'O(R''O)_c$ and mixtures thereof, R' is selected from the group consisting of hydrogen and a hydrocarbon radical having from 1 to 18 carbon atoms, R'' is a divalent hydrocarbon radical having from 2 to 6 carbon atoms, $R^1$ and $R^2$ are each selected from the group consisting of a monovalent hydrocarbon radical having from 1 to 10 carbon atoms, a radical of the formula R''OH and hydrogen, c is an integer of from 0 to 600 and x is a number of from 1 to 4.

3. The method of claim 1, wherein the aminosilicon compound is an aminosilazane of the formula

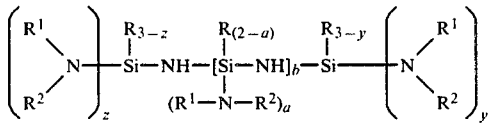

where R is selected from the group consisting of a monovalent hydrocarbon radical having from 1 to 18 carbon atoms, a radical of the formula $R'O(R''O)_c$ and mixtures thereof, R' is selected from the group consisting of hydrogen and a hydrocarbon radical having from 1 to 18 carbon atoms, R'' is a divalent hydrocarbon radical having from 2 to 6 carbon atoms, $R^1$ and $R^2$ are each selected from the group consisting of a monovalent hydrocarbon radical having from 1 to 18 carbon atoms, a radical of the formula R''OH and hydrogen, where R'' is the same as above, a is 1 or 2, b is an integer of from 0 to 3, c is an integer of from 0 to 600, y is a number of from 0 to 3 and z is a number of from 0 to 3 and the sum of y+z is at least 2.

4. The method of claim 1, wherein the aminosilicon compound is combined with a carrier.

5. The method of claim 1, wherein the aminosilicon compound is applied to the metal substrate.

6. The method of claim 4, wherein the aminosilicon compound and carrier are applied to the metal substrate.

7. The method of claim 4, wherein the carrier is a solid.

8. The method of claim 7, wherein the carrier is a solid organopolysiloxane which is capable of subliming at room temperature.

9. The method of claim 4, wherein the carrier is an organopolysiloxane fluid.

10. The method of claim 4, wherein the carrier is a petroleum oil.

11. The method of claim 7, wherein the carrier is a silica gel.

12. The method of claim 9, wherein the organopolysiloxane fluid contains at least one hydroxyl group and has a viscosity of from 2 to 100 mPa.s at 25° C. and is substantially free of fillers.

13. The method of claim 4, wherein the aminosilicon compound is applied to an absorbent sheet and the metal substrate is exposed to the absorbent sheet.

14. The method of claim 13, wherein the metal substrate is wrapped in the absorbent sheet.

* * * * *